US005129325A

United States Patent [19]

Matzagg

[11] Patent Number: 5,129,325

[45] Date of Patent: Jul. 14, 1992

[54] EJECTOR DEVICE FOR GRENADE PROJECTOR OR MORTAR PROJECTILES FOR SIMULATING FIRING

[75] Inventor: Erich Matzagg, Oberndorf-Beffendorf, Fed. Rep. of Germany

[73] Assignee: Mauser-Werke Oberndorf GmbH, Oberndorf/Brd, Fed. Rep. of Germany

[21] Appl. No.: 738,187

[22] Filed: Jul. 30, 1991

[30] Foreign Application Priority Data

Aug. 2, 1990 [DE] Fed. Rep. of Germany ..... 4024540

[51] Int. Cl.[5] ..... F42B 8/20

[52] U.S. Cl. ..... 102/445; 102/372; 102/395; 102/498; 102/529

[58] Field of Search ..... 102/444–447, 102/483, 529, 530, 531, 372, 395, 482, 498; 42/105

[56] References Cited

U.S. PATENT DOCUMENTS

| | | | |
|---|---|---|---|
| 2,415,803 | 2/1947 | Abell | 102/483 |
| 3,343,488 | 9/1967 | Sherwood | 102/529 |
| 4,549,487 | 10/1985 | Jensen | 102/445 |

*Primary Examiner*—Harold J. Tudor
*Attorney, Agent, or Firm*—McGlew & Tuttle

[57] ABSTRACT

There is proposed an ejector device (6) for grenade projector or mortar projectiles (1), which permits simulation of mortar firing even in halls or very limited areas. It is known that blank cartridges (17) for rifles, pistols or bolt firing devices have only a slight degree of scatter in terms of gas pressure. Therefore the ejection speed of a piston (13) which is inserted into the ejector device (6) and which is driven by the powder propellent gases of the blank cartridge (17) is always the same. In that way it is always possible to achieve the same firing ranges of only a few meters.

7 Claims, 1 Drawing Sheet

EJECTOR DEVICE FOR GRENADE PROJECTOR OR MORTAR PROJECTILES FOR SIMULATING FIRING

FIELD OF THE INVENTION

The invention relates to an ejector device for grenade projector or mortar projectiles for simulating firing, comprising a propellent charge which is disposed in a separate chamber in the projectile body.

BACKGROUND OF THE INVENTION

DE30 33 061 Al discloses a grenade projector training projectile which is provided with a head portion and a tail portion, a propellent charge in the tail portion, and a smoke-producing signal charge which is disposed in front of the propellent charge. In that training or practice projectile, the propellent charge is disposed in a separate chamber which is fitted into the rear end of the tail portion. The aim with that training or practice projectile is to provide that handling thereof is substantially the same as a corresponding live projectile, while permitting good impact marking in the target area in spite of the absence of an explosion effect upon impact. Therefore the marking charge is disposed in the tail tube of the training or practice projectile, separately from the propellent charge. It is not possible for that training or practice projectile to simulate firing from a mortar in a very small area.

DE 84 24 969 Ul discloses a large-caliber training or practice projectile and a simulator system for that projectile. That arrangement particularly endeavours to imitate actual projectiles, in substantially the same manner as regular equipment, so that it is possible to emulate actual firing conditions.

In order to be able to fire off that practice projectile over variable ranges and in order to be able to load the practice or training grenades rapidly in a regular weapon for training purposes, while simulating actual firing conditions, the head portion of that training projectile has an internal gas passage with openings for the entry of the propellent gases. Further bores are provided for discharge of the propellent gases whereby, when the training projectile is fired, the effect produced is that the resulting propellent gases are passed through the inner openings forwardly along the internal passage and out of the discharge openings again. The entry openings can be closed off by plugs or stoppers whereby different cross-sectional areas are defined as between the entry openings. By opening or closing such entry openings, it is possible to vary the firing range of such a practice grenade from 250 meters to 600 meters. That means that this training projectile is not suitable for firing simulation in a very small area and is assembly shops.

SUMMARY AND OBJECTS OF THE INVENTION

The object of the invention is to provide an ejector device for grenade projector or mortar projectiles for simulating firing, which using simple means, permits handling of a mortar or a grenade projector in a hall or on a restricted training area and which retains all the same movements as are involved with a live projectile.

According to the invention, an ejector device for simulating firing of grenades or mortar projectiles is provided comprising a projectile body with a separate chamber into which there is disposed a propellant charge. The chamber is defined in the form of a blind bore provided in one end of a piston, extending in the direction of a longitudinal axis of the piston. The piston is arranged in a hollow cylinder which is inserted into the projectile body. The hollow cylinder is provided with an end face which is toward a head portion of the projectile. This end face is closed by an end portion which is axially spaced relative to the chamber. The end portion carries a striker pin for engaging the propellant charge, which is in the chamber. The piston is held in a position in the hollow cylinder by a spring-loaded retaining pin. The spring-loaded retaining pin engages into a retaining notch, retaining groove or retaining bore formed in an inside wall of the cylinder. The spring-loaded retaining pin is secured by a securing pin which is supported in the piston.

The hollow cylinder is preferably inserted in a tail portion of the projectile, preferably in a bore formed in the tail portion. The propellant charge is preferably in the form of a blank cartridge inserted into the chamber. Preferably, a propellant charge of different energy can be selected and inserted into the chamber.

The cylindrical wall is preferably provided with gas outlet openings allowing the piston to be moved relative to the cylinder. The retaining pin is preferably fitted in a radially extending blind bore in the piston. The compression spring is supported against the bottom of the blind bore and the retaining pin is moveable axially in a limited manner by a pin in the piston. The piston is provided with an enlarged diameter with an annular surface at an end which is toward the end portion. An open end of the hollow cylinder, which is remote from the end portion, is of a reduced diameter with an annular surface which faces towards the annular surface of the piston. Both of the annular surfaces are axially spaced from each other and form a limit abutment for the piston movement.

In the known large-caliber training or practice projectiles for mortars and grenade projectors in accordance with the sate of the art, there is at the present time no possibility of simulating loading a mortar in an assembly shop or hall or in an only restrictedly available space. Even special charges for training or practice projectiles require a relatively large, safeguarded space. Due to the relatively large initial combustion chamber and the large degree of gas slippage through the air gap between the projectile and the firing projector, it is often difficult to operate with a suitable charge which reliably throws the large-caliber training or practice projectile only a few metres away. It is here that the invention now follows a completely different path. It is known that blank cartridges for rifles or pistols or for bolt firing devices have only a very slight degree of scatter in terms of gas pressure. Therefore the speed of ejection of the piston used in accordance with the invention, which is driven by the powder gases of the blank cartridge employed, is always the same. In that way it is always possible to attain the same ranges. At the end of the acceleration travel of the piston, there are also outlet openings so that there is no pressure applied to the piston upon dismantling of the ejector device from a fired mortar cartridge.

By virtue of the kinetic energy of the mortar projectile, due to the force of gravity, when it impacts against the bottom portion in the mortar barrel, the piston is struck against the fixed striker pin in the ejector device, whereby the blank cartridge mounted in the piston is fired. The powder gases which are liberated when that happens drive the piston at high speed against its annular abutment in the hollow cylinder. The piston thrusts itself away from the bottom portion of the mortar barrel and thus throws the training or practice projectile only a few metres out of the barrel.

BRIEF DESCRIPTION OF THE DRAWINGS

An example of the invention is illustrated in the drawing in which.

DETAILED DESCRIPTION OF THE PREFERRED EMBODIMENT

Figure 1:
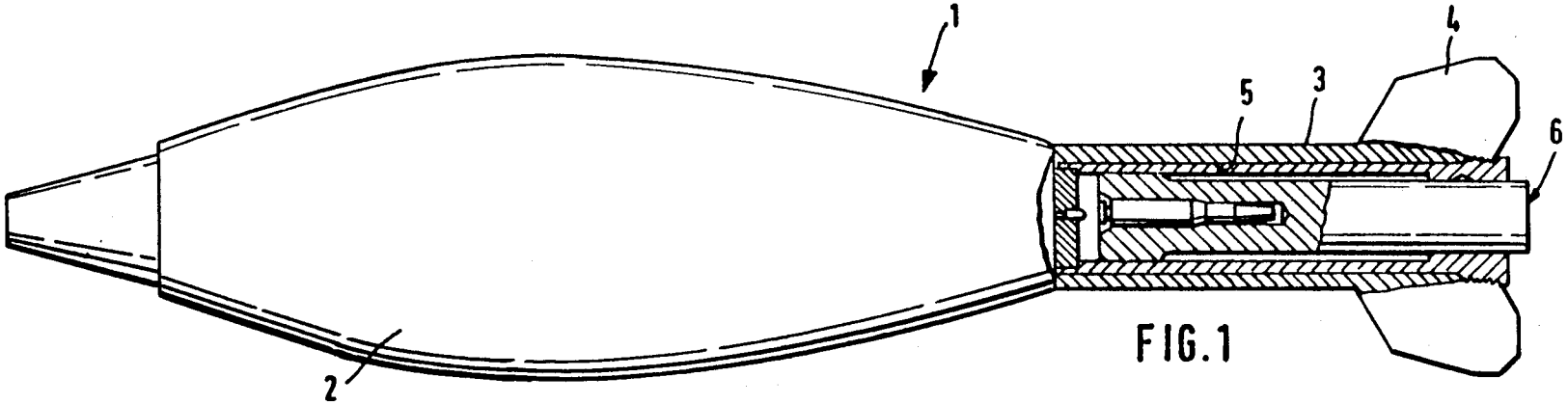
FIG. 1 is a partly sectional view of a grenade projector projectile with an ejector device of the kind according to the invention.

The grenade projector or mortar projectile 1 comprises a head portion 2 and a tail portion 3 with stabilising fins 4. Extending in the tail portion 3 from the rearward end is a blind bore 5 which accommodates the ejector device 6. The ejector device 6 for the mortar projectile 1 for simulating firing comprises a hollow cylinder 7 which is screwed by means of a screwthread 8 into the tail portion 3 until it bears against an abutment 9. At its end 10 which is towards the head portion 2, the hollow cylinder 7 is closed by an end portion 11 with a striker pin 12 which is fitted centrally therein. Disposed in the hollow cylinder 7 at an axial spacing from the end portion 11 is a piston 13 having a blind bore 15 which extends into the piston from the end 14 which is towards the end portion 11. The blind bore 15 is disposed on the longitudinal axis of the projectile body, as indicated at 16. A blank cartridge 17 is inserted into the blind bore 15.

The rear end of the piston 13, which is towards the end portion 11, is of an enlarged diameter with an axial annular surface as indicated at 18.

At the end remote from the end portion 11, the piston 13 is provided with a radial blind bore 19. Fitted into the blind bore 19 is a retaining pin 20, the bottom surface 21 of which has an opening 22 into which engages a spring 23 which bears against the end 24 of the blind bore 19. At its head end, the retaining pin 20 engages into a suitable retaining groove or retaining notch 25 in the inside wall 26 of the hollow cylinder 7.

A transverse bore 27 in the retaining pin 20, which bore 27 extends substantially parallel to the longitudinal axis 16 of the projectile, accommodates a securing pin 28 which is supported in a suitable bore 29 in the piston 13. A pull ring 30 is disposed on the securing pin 28 at the rearward end of the ejector device 6.

The axial movement of the retaining pin 20 in the blind bore 19 is limited by a pin 31 which is fixedly inserted in the piston 13 and engages into a recess 32 in the edge of the retaining pin 20.

In its front region the hollow cylinder 7 has gas outlet openings 33 which are disposed at the end of the acceleration travel of the piston 13 upon movement thereof in the direction indicated by the arrow 34. By virtue of the gas outlet openings 33, the piston 13 is under no pressure upon dismantling of the ejector device 6 from the mortar projectile 1.

In the region of the end of the projectile, the hollow cylinder 7 is of a reduced diameter whereby the arrangement forms an axial annular surface 35 on the hollow cylinder 7, which is disposed opposite the annular surface 18 on the piston. The two annular surfaces 18 and 35 form a limit abutment in regard to movement of the piston 13 within the hollow cylinder 7 in the direction indicated by the arrow 34.

Disposed in front of the blind bore 19 in the piston 13 is a further radial blind bore 36.

Simulation of firing with the mortar projectile is effected by the mortar projectile 1 being introduced into the barrel (not shown here) of a mortar from the muzzle thereof. Due to the kinetic energy of the mortar projectile 1, under the force of gravity, upon impact thereof against the bottom portion of the mortar barrel, the piston 13 is now struck against the fixed striker pin 12 in the end portion 11 of the ejector device 6 whereby the blank cartridge 17 mounted in the piston 13 is fired.

The powder propellent gases which are now liberated when that happens drive the piston 13 at high speed against its abutment 18 and 35 in the hollow cylinder 7. The piston 13 is consequently driven out of the rear end of the projectile and, when it does that , ti thrusts itself away from the bottom portion of the barrel in the mortar and throws the mortar projectile 1 together with the ejector device 6 out of the mortar barrel. The range of the mortar projectile when fired out of the mortar in that way is only a few metres after leaving the barrel so that this device is suitable for effecting simulation of mortars and mortar projectiles in a hall or on very small areas.

Figure 2:
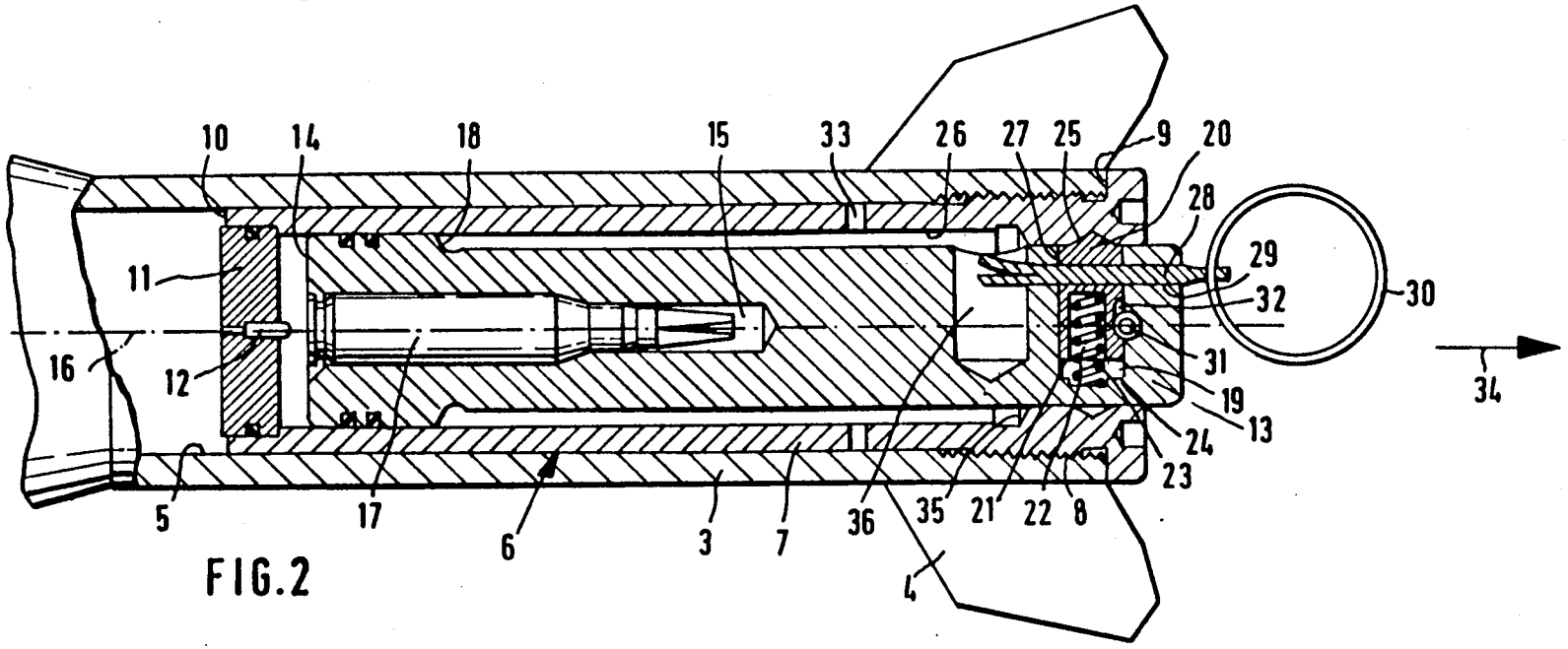
FIG. 2 is a view in section of the ejector device for a grenade projector or mortar projectile shown in FIG. 1.

The piston 13 is held in its storage or transportation position in the cylinder as shown in FIG. 2 by the retaining pin 20. It is only after the securing pin 28 has been pulled out by way of the ring 30 that it is possible for the retaining pin 20 to move within the blind bore 19 against the force of the spring 23. The energy which is liberated when the blank cartridge 17 is fired is sufficient to cause the retaining pin 20 to be urged out of the retaining groove 25 until it bears against the stop pin 31, when the piston 13 moves in the direction indicated by the arrow 34.

I claim:

1. An ejector device for simulating firing of a grenade or mortar projectile, comprising:

a piston defining a chamber for receiving a propellant charge, said chamber being formed as a blind bore provided at one end of the piston extending substantially along a longitudinal axis of said piston;

a hollow cylinder inserted in a projectile body, said piston being positioned slidably received within said hollow cylinder, said hollow cylinder including a rear end face and head end face positioned toward a head portion of the projectile body, said piston having a rear portion extending rearwardly of said cylinder rear end face, said cylinder head end face beign closed by an end portion, said end portion being axially spaced relative to said chamber;

a striker pin held by said end portion; and a spring-loaded retaining pin in said piston engaging one of a retaining notch, a retaining groove and a retaining bore, formed in an inside wall of said cylinder for holding said piston in position in said hollow cylinder, said spring-loaded retaining pin being secured via a securing pin supported in said piston.

2. An ejector device according to claim 1, wherein said hollow cylinder is inserted in a bore formed in a tail portion of said projectile body.

3. An ejector device according to claim 1, wherein said propellant charge is provided as a blank cartridge inserted in said chamber.

4. An ejector device according to claim 1, wherein said propellant charge may be selected from propellant charges of different energy.

5. An ejector device according to claim 1, wherein said cylinder wall is provided with gas outlet openings.

6. An ejector device according to claim 1, wherein said retaining pin is fitted in a radially extending blind bore formed in said piston, a compression spring being supported against a bottom part of said blind bore, said retaining pin being moveable axially within a range defined by a pin positioned in said piston.

7. An ejector device according to claim 1, wherein said piston includes an end towards said end portion having a piston annular surface of an enlarged diameter, said hollow cylinder having an annular surface of reduced diameter which faces said annular surface of said piston, said annular surface of reduced diameter of said hollow cylinder and said annular surface of enlarged diameter of said cylinder being axially spaced from each other to form a limit abutment, limiting movement of said piston.

* * * * *